US005311024A

United States Patent [19]

Marman et al.

[11] Patent Number: 5,311,024

[45] Date of Patent: May 10, 1994

[54] LENS ARRANGEMENT FOR INTRUSION DETECTION DEVICE

[75] Inventors: Douglas H. Marman, Ridgefield, Wash.; William E. Abel, Portland, Oreg.

[73] Assignee: Sentrol, Inc., Portland, Oreg.

[21] Appl. No.: 850,339

[22] Filed: Mar. 11, 1992

[51] Int. Cl.[5] ..... G08B 13/18

[52] U.S. Cl. ..... 250/353; 250/342; 359/742

[58] Field of Search ..... 250/353, 342; 359/742

[56] References Cited

U.S. PATENT DOCUMENTS

| | | | |
|---|---|---|---|
| 4,375,034 | 2/1983 | Guscott | 250/342 |
| 4,707,604 | 11/1987 | Guscott | 250/342 |
| 4,757,204 | 7/1988 | Baldwin et al. | 250/342 |
| 4,990,783 | 2/1991 | Muller et al. | 250/353 |
| 5,017,783 | 5/1991 | Mousavi | 250/353 |
| 5,026,990 | 6/1991 | Marman et al. | 250/342 |

OTHER PUBLICATIONS

COIL ceiling lens sales literature (1 page) of Combined Optical Industries Ltd. Netherlands undated.

*Primary Examiner*—Carolyn E. Fields

*Attorney, Agent, or Firm*—Stoel Rives Boley Jones & Grey

[57] ABSTRACT

Fresnel lens elements in a lens grouping and mounted in a fixed relationship to a detector, to define a 360° field of view for use in a sensor for passive detection of infrared radiation. Lens elements of the lens grouping can be selected by masking other lens elements, to leave a lens array defining a particular pattern of detection for a desired application. By masking certain of the lenses of the lens grouping, wide angle three-dimensional or fan-like planar curtain patterns of detection are obtained for use of the sensor in either a wall-mounted or ceiling-mounted installation, and vertical curtains of coverage can be obtained using ceiling-mounted installation. Lens elements of different sizes and focal lengths are arranged to gather ample radiation for detection of distant intruders in certain directions.

19 Claims, 9 Drawing Sheets

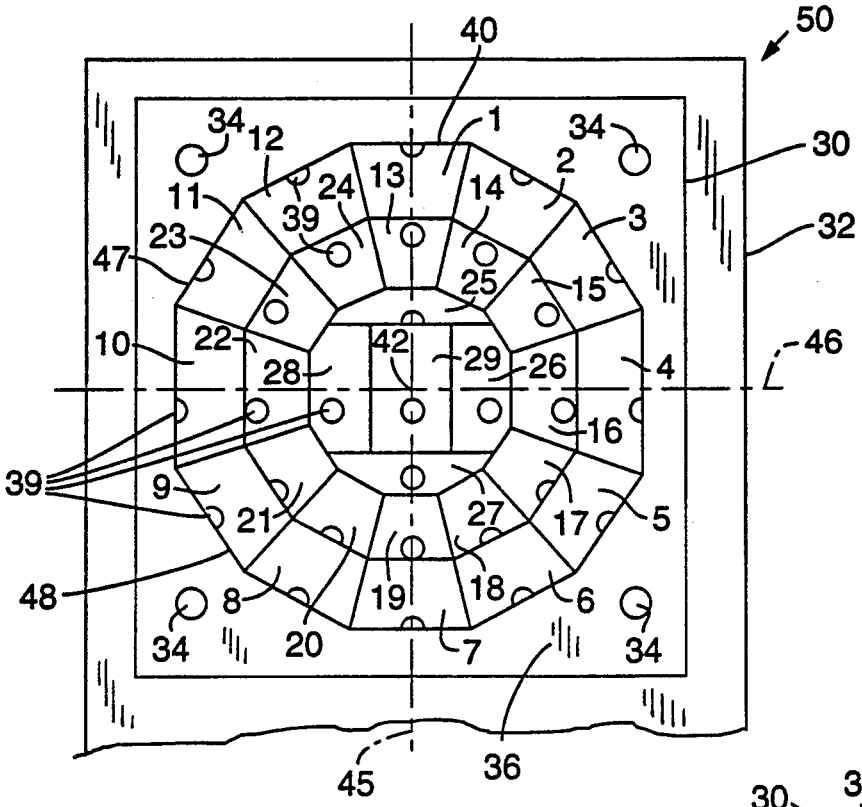
FIG. 1
FIG. 2
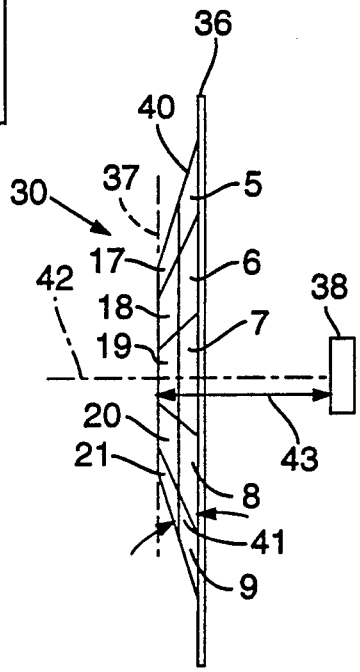
FIG. 3
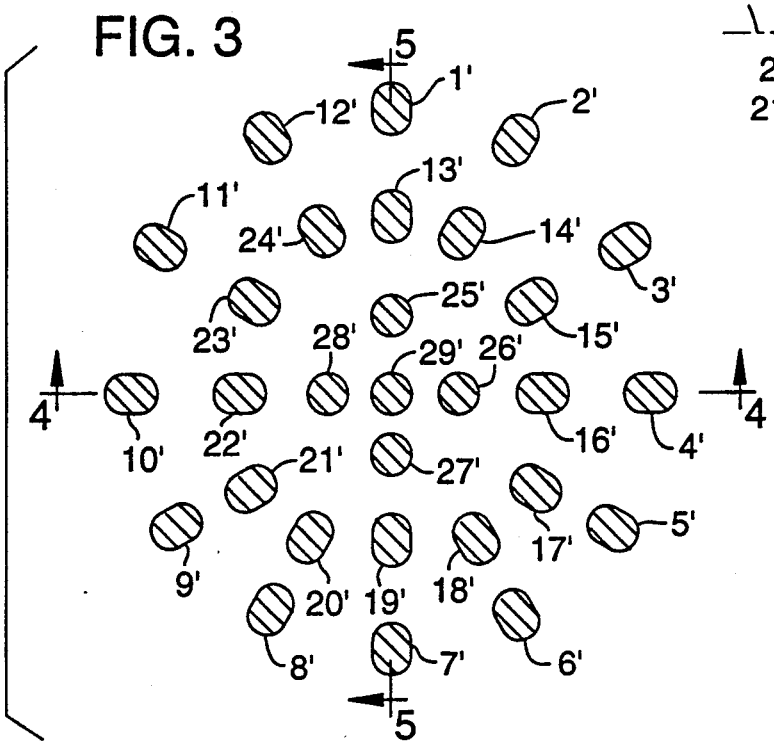

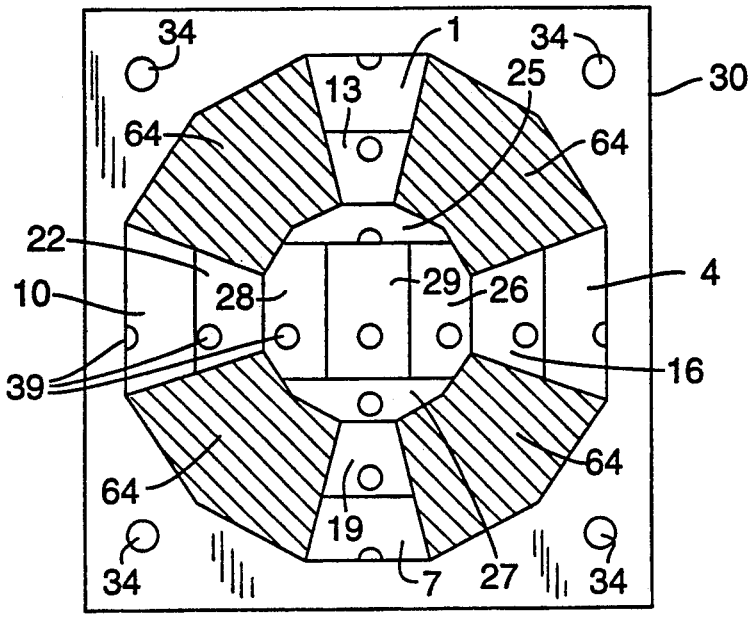
FIG. 27
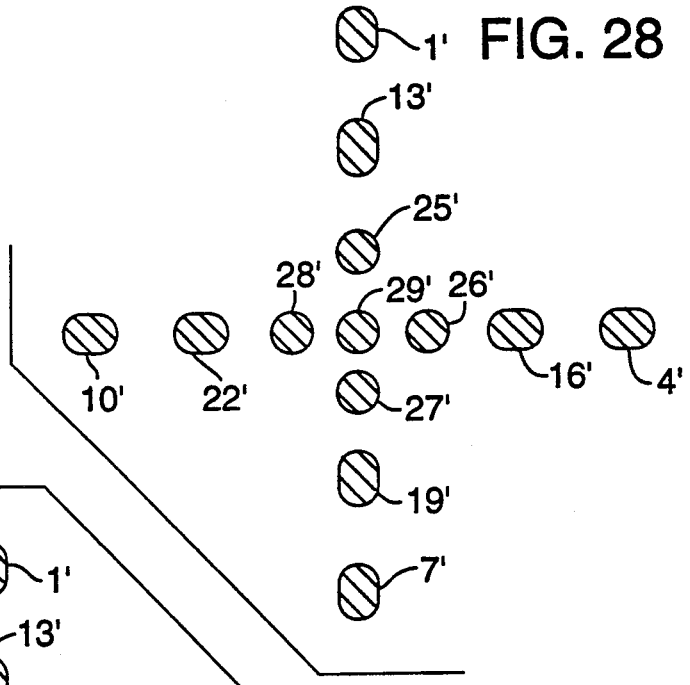
FIG. 28
FIG. 29
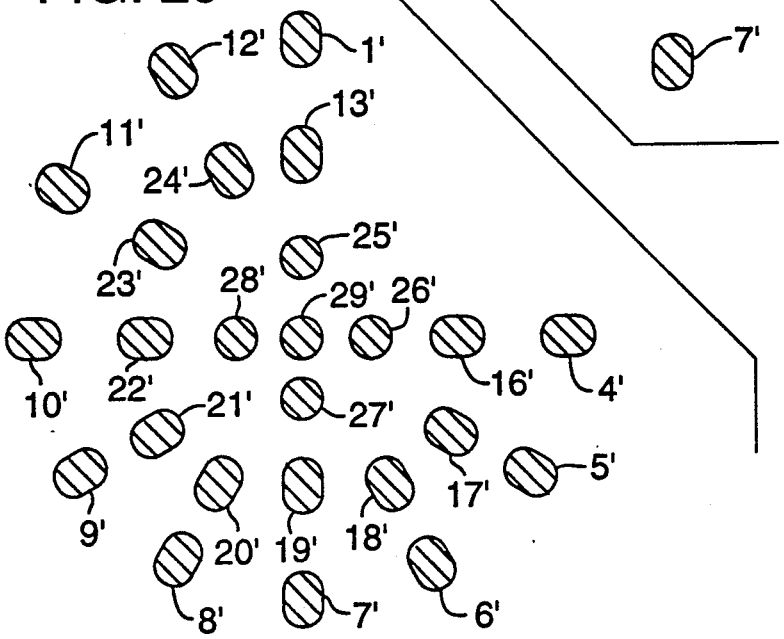

LENS ARRANGEMENT FOR INTRUSION DETECTION DEVICE

BACKGROUND OF THE INVENTION

The present invention relates to intrusion detection devices, and more particularly to a Fresnel lens grouping for an infrared sensor for mounting either on a wall or a ceiling.

Infrared sensors incorporating multiple Fresnel lens elements are known for use in detecting the presence of intruders in protected spaces. Some previous attempts to provide 360° coverage for infrared radiation detection have relied on combinations of mirrors and Fresnel lenses, but this approach is undesirably expensive.

Mousavi U.S. Pat. No. 5,017,783 discloses a system based on a combination of Fresnel lenses and Fresnel prisms that is designed to provide a 360° pattern of coverage when mounted, typically, on a ceiling.

Guscott U.S. Pat. No. 4,375,034 discloses using a combination of mirrors to produce a curtain of infrared detection for protecting a space from unwanted intrusion.

Guscott U.S. Pat. No. 4,707,604 discloses a ceiling mountable system based on mirrors that provides a plurality of radially outwardly extending generally vertical first curtains, a horizontal second generally disc-shaped pattern of sensitivity, and a conical downwardly directed third zone of sensitivity.

Muller et al. U.S. Pat. No. 4,990,783 also discloses use of mirrors to devise a curtain-like vertical zone of detection.

None of these infrared sensing devices, however, is capable of providing in a single reasonably inexpensive sensor device, at the option of the user, useful intrusion detection for a room either when mounted on a ceiling to provide 360° coverage, or when mounted on a wall to provide wide-angle coverage or long-distance sensitivity.

What is still needed, then, is a single relatively inexpensive infrared sensing device for use in intrusion detection systems, mountable either on a wall or the ceiling, with the versatility for selectively providing horizontal fan-shaped zones of sensitivity, vertical curtains of sensitivity, all-around coverage, wide angle coverage, and long-range, narrow-field infrared detection coverage, all through the use of a single low-cost lens unit.

SUMMARY OF THE INVENTION

The present invention provides a lens unit including a grouping of Fresnel lens elements for a radiation sensing device such as an infrared-sensitive detector element. The total area defined by the lens grouping is preferably apportioned among the individual lens elements such that a primary lens element has the greatest light gathering ability. Lens elements peripheral to the primary lens element preferably have light gathering ability equal to or less than the primary lens element. Each Fresnel lens element may be used or individually obscured, as by an adhesively or otherwise attached infrared-opaque mask, leaving selected elements available to transmit infrared radiation to the detector element. In a preferred embodiment of the invention the sensing device can be mounted on a wall or a ceiling. The present invention also provides a mask element unit for obscuring a predetermined number of certain of the lens elements of the lens grouping. Each lens element of the lens grouping defines a respective beam of sensitivity for directing infrared radiation to the detector element.

In a preferred embodiment of the invention the Fresnel lens elements are arranged in the lens unit to include a first plurality of Fresnel lens elements arranged to form a generally planar array of beams of sensitivity in a first plane, together with a second plurality of Fresnel lens elements arranged to form a generally planar second array of beams of sensitivity in a second plane, the two planes intersecting each other along a line originating at the lens grouping. The individual lens elements chosen as the first and second pluralities can be selected from the lens grouping so the two planes defined by the several beams of sensitivity are orthogonal. First and second lens element pluralities can also be selected to define generally planar arrays of beams of sensitivity in planes that intersect at some acute angle along a line originating at the lens grouping.

In a preferred embodiment of the invention the lens grouping includes additional Fresnel lens elements defining beams of sensitivity located between the orthogonal planes. Furthermore, these additional lens elements can be selected to define additional beams of sensitivity lying in concentric circles, the additional lens elements themselves preferably being concentrically arranged about a central lens element containing the central axis of the lens grouping.

It is therefore a principal object of the invention to provide a lens unit for an infrared-sensitive intrusion detection device which makes the intrusion detection device easily useful both in typical wall-mount applications and typical ceiling-mount applications.

It is another object of the invention to provide an infrared sensing device capable of detecting intrusion by using selected lens elements of a lens grouping to define one or more curtain-like arrays of beams of sensitivity and by using other selected combinations of lens elements of the lens grouping to give a wide-angle pattern of beams of sensitivity.

It is a still further object of the invention to provide an infrared sensing device including a lens unit capable of providing intrusion detection above a certain height defined by a generally horizontal fan-shaped pattern of beams of sensitivity, while leaving a "pet alley" below that height, where pets can move normally without causing an alarm condition.

It is a further object of the invention to provide an infrared sensing device capable of providing long-range intrusion detection, as along the length of a narrow room or hallway.

It is an important feature of the present invention that it provides an infrared sensing device including a lens unit which can be mounted on a ceiling to provide full 360° intrusion detection, or, alternatively, can be mounted on a wall to provide a useful wide-angle pattern of sensitivity for intrusion detection for a room, and which includes lens elements of various sizes in which larger elements are arranged to collect radiation from more distant intruders.

It is an important feature of the invention that it provides a lens unit including lens elements arranged to provide broad coverage of a space regardless of whether the sensing device is mounted on a wall or mounted on the ceiling.

The foregoing and other objectives, features, and advantages of the invention will be more readily understood upon consideration of the following detailed description of the invention, taken in conjunction with the accompanying drawings.

BRIEF DESCRIPTION OF THE DRAWINGS

FIG. 1 is a front view of an infrared sensing device including a lens unit containing a plurality of Fresnel lens elements and embodying the features of the present invention.

FIG. 2 is a partially schematic side view of the infrared sensing device of FIG. 1.

FIG. 3 is a schematic view of the beams of sensitivity defined by the lens grouping of FIG. 1, taken in a plane perpendicular to the central axis of the lens unit.

FIG. 27 is a front view of the lens unit of a sensing device as shown in FIG. 1 with portions of the lens grouping shown symbolically as being masked in preparation for mounting on a wall or ceiling.

FIG. 28 is a schematic view showing a plurality of beams of sensitivity defined by the lens grouping of FIG. 27, taken in a plane perpendicular to the central axis of the lens unit.

FIG. 29 is a schematic view showing a plurality of beams of sensitivity taken in a plane perpendicular to the central axis of the lens unit forming the beams of sensitivity.

DETAILED DESCRIPTION OF THE INVENTION

Figure 4:
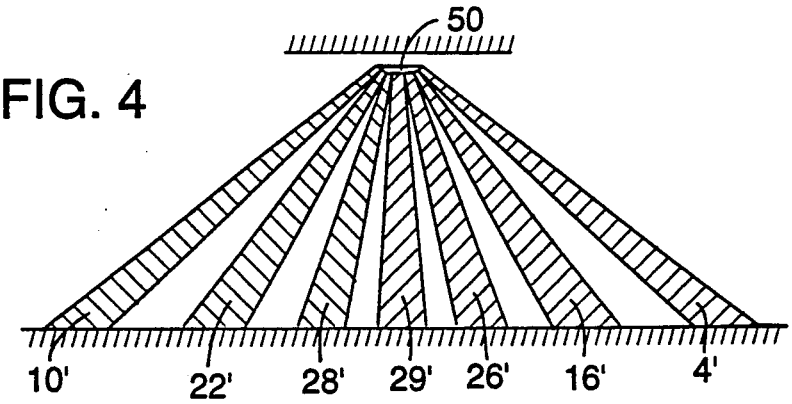
FIG. 4 is a schematic side view showing a plurality of beams of sensitivity defined by a first plurality of Fresnel lens elements of the lens unit shown in FIG. 1, taken in a plane including line 4—4 of FIG. 3.

Referring first to FIGS. 1 and 2 of the drawings, a lens unit 30 which is a preferred embodiment of the invention is shown larger than actual size in FIG. 1. The lens unit 30 is intended for use as part of a sensing device 50 for use, for example, in an intrusion detection system or occupancy-monitoring system. The sensing device 50 is not shown in detail in the present drawings, but it includes a body 32 to which the lens unit 30 is normally fastened, as by the use of screws or other suitable fasteners fitted through holes 34 defined in a planar base portion 36 of the lens unit. The body 32 is adapted to be secured to a wall or ceiling of a room, by conventional fastening devices such as screws or adhesives which are not shown, so that the base portion 36 is parallel to the wall or ceiling on which the sensing device 50 is mounted.

Housed within the body 32 along with necessary electronic circuits which do not form a part of the present invention is a detector 38 including at least one sensitive element sensitive to radiation in at least a particular wavelength band of interest, such as the infrared region of the spectrum. The presence of an intruder can be sensed by detector 38 sensing the body heat of the intruder which is radiated toward the sensing device 50 in the form of infrared radiation and which has been focused on the detector 38 by the lens unit 30. Any suitable detector, such as a piezoelectric film, crystal, or ceramic pyrometer detector, may be employed in the invention. It will be understood that the detector 38 may be connected to electronic circuitry capable of detecting electrical changes due to movement of a source of infrared radiation, and for that purpose may include more than a single sensitive element.

Twenty-nine Fresnel lens elements, indicated by sequential reference numerals 1 through 29, form the lens grouping 40 of the lens unit 30 of the preferred embodiment. Each such lens element is located so as to focus the infrared radiation which passes through it onto the infrared radiation detector 38. Each of the lens elements has an optical axis, radiation having the predetermined wavelength and travelling along the optical axis being focused generally on a focal point located proximate the sensitive element of the detector. The lens elements are preferably single, positive, grooves-in type lenses, used grooves in, although it will be appreciated that other positive type lens elements might also perform satisfactorily. The lens unit 30 is compression or injection molded, and is preferably integrally molded of an infrared-transparent plastics material, such as that used in infrared lenses manufactured by Fresnel Technologies, Inc. of Ft. Worth, Tex., under the trademark "Low-dif."

The lens unit 30 is formed so that each of the 29 Fresnel lens elements 1 through 29 has its rear surface, the grooved side, facing inward toward the detector 38. In the preferred embodiment shown, lens elements 1, 2, 3, 4, 5, 6, 7, 8, 9, 10, 11 and 12 are 0.9 inch (22.86 mm) focal length lenses, lens elements 13, 14, 15, 16, 17, 18, 19, 20, 21, 22, 23 and 24 are 0.77 inch (19.56 mm) focal length lenses, and lens elements 25, 26, 27, 28 and 29 are 0.65 inch (16.51 mm) focal length lenses. The optical center of each of the lens elements 1, 2, etc., through 29 is indicated in FIG. 1 by a small circle 39 or part of such a circle.

The lens elements are arranged so that a vertical plane 45 containing the central axis 42 of the lens grouping 40 bisects the lens elements 1, 13, 25, 29, 27, 19, and 7. The optical centers of lens elements 10, 22, 28, 29, 26, 16, and 4 are also arranged so that a horizontal plane passing through those optical centers is parallel to and slightly below the horizontal plane 46. Each member of this group of lens elements 10, 22, 28, 29, 26, 16 and 4 has a larger area than other lens elements of the lens grouping 40. This larger lens area, together with the longer focal length of each of these lens elements, provides greater effective detection distance than is possible (for a given target, or source of infrared radiation) for the other, smaller lens elements. The centrally located lens element 29 has a larger lens area than any other lens element in the lens grouping 40, and thus provides a greater effective detection distance than any other lens element in the lens grouping 40.

Other lens elements 2, 3, 5, 6, 8, 9, 11, 12, 14, 15, 17, 18, 20, 21, 23 and 24 are arranged between the lens elements 1, 13, 25, 29, 27, 19, and 7 whose optical centers are bisected by an imaginary vertical plane 45 perpendicular to the base 36 of the lens unit 30 (FIG. 1) and the lens elements 10, 22, 28, 29, 26, 16, and 4 whose optical centers lie slightly below the imaginary horizontal plane 46 (FIG. 1) containing the central axis 42. These additional lens elements are arranged symmetrically in relation to the vertical plane 45. The horizontal plane 46, however, is not a plane of symmetry. This arrangement of lens elements allows the sensing device to provide wide-angle, long range infrared detection which is useful, for example, over a "pet alley", as will be explained in more detail below.

The lens unit 30 is square, with each side 1.700 inches (4.318 cm) long. As illustrated in FIG. 2, the lens elements 25, 26, 27, 28, and 29 occupy the essentially flat center area of the lens grouping 40 in a plane 37 parallel to the base 36 of the lens unit 30, while pairs of lens elements, such as lens elements 7 and 19, 8 and 22, and 6 and 18 are on opposite sides of the center area and are sloped, as at an angle 41, from the plane of the base 36 of the lens unit outward and toward the central axis 42 and the flat center area of the lens unit, so that the lens unit 30 is in the general form of a flat-sided, flat-topped dome. The key relationship is that all the lens elements must be positioned properly to refract radiation from each beam of sensitivity to the sensitive element of the detector 38.

FIG. 2 depicts the relationship of the lens grouping 40 along the central axis 42 of the lens grouping to the detector 38. Although the sensing device 50 can be mounted on a wall, on a ceiling, or on another surface with a desirable orientation, the relationship between the lens grouping 40 and the detector 38 will remain constant. In a preferred embodiment this distance 43 is 0.65 inches (1.65 cm) from the rear surface of the center of the lens grouping to the detector element.

Each lens element of the lens grouping 40 defines a projected detection zone or beam of sensitivity which expands conically from the respective lens element along its optical axis. Infrared energy, such as that emitted from a warm body, radiating toward the sensing device from an object located in the projected detection zone or beam of sensitivity of a lens element will be refracted by the respective lens element and directed to the sensitive element of the detector 38.

In FIG. 3, each shaded area 1' through 29' represents a beam of sensitivity 1' through 29' defined, respectively, by the lens elements 1 through 29 shown in FIG. 1, as projected onto a plane perpendicular to the central axis 42 of the lens grouping 40. FIG. 3 represents the pattern of the beams of sensitivity as projected on a plane located some distance beneath the infrared sensing device 50, including the lens grouping 40 of the present invention, mounted on a ceiling. The beams of sensitivity 1', 2', 3', 4', 5', 6', 7', 8', 9', 10', 11', and 12' describe an outer circular pattern, the beams of sensitivity 13', 14', 15', 16', 17', 18', 19', 20', 21', 22', 23', and 24' describe an inner circular pattern, and of sensitivity 25', 26', 27', and 28' describe a third, innermost, circular pattern, about a central beam of sensitivity 29'.

Figure 5:
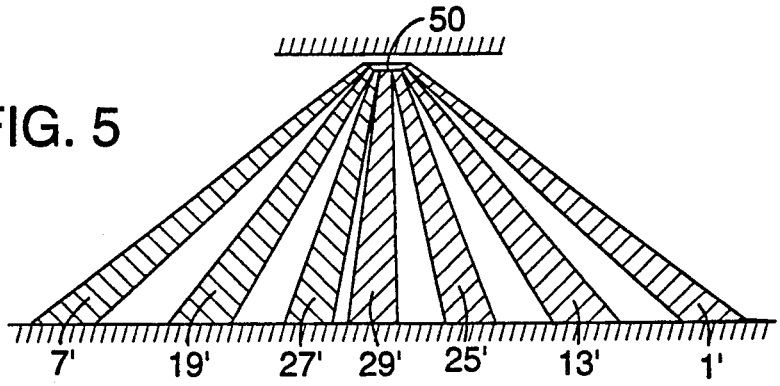
FIG. 5 is a schematic side view showing a plurality of beams of sensitivity defined by a second plurality of Fresnel lens elements of the lens unit shown in FIG. 1, taken in a plane including line 5—5 of FIG. 3.

FIGS. 4 and 5 represent sectional views of the beams of sensitivity projected by the infrared sensing device of FIG. 1 when mounted on a ceiling, with the plane of the base 36 of the lens unit 30 in a horizontal orientation. In FIG. 4, the section is taken through beams of sensitivity 10', 22', 28', 29', 26', 16', and 4' defined by lens elements 10, 22, 28, 29, 26, 16 and 4. In FIG. 5, the section is taken through beams of sensitivity 1', 13', 25', 29', 27', 19', and 7' defined by Fresnel lens elements 1, 13, 25, 29, 27, 19, and 7.

Figure 6:
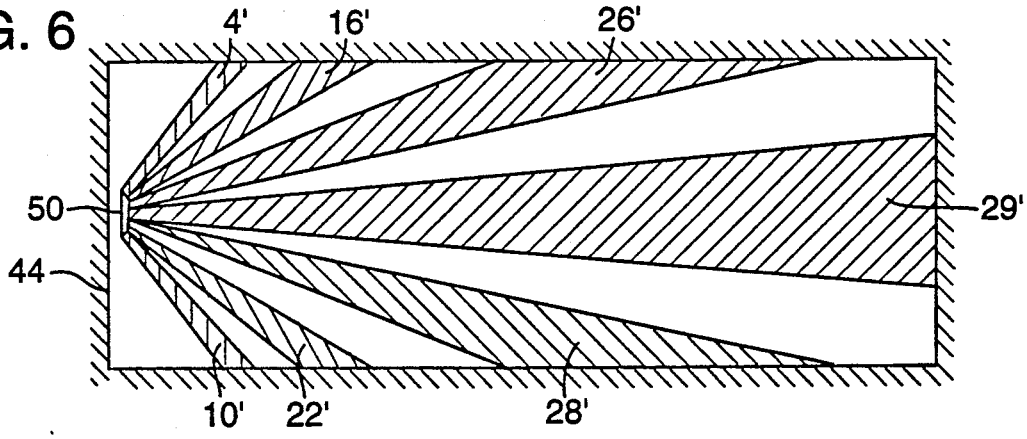
FIG. 6 is a schematic top view showing a plurality of beams of sensitivity defined by the lens elements just below the horizontal plane of the lens grouping of the sensing device of FIG. 1 when the sensing device is mounted on a wall.
Figure 7:
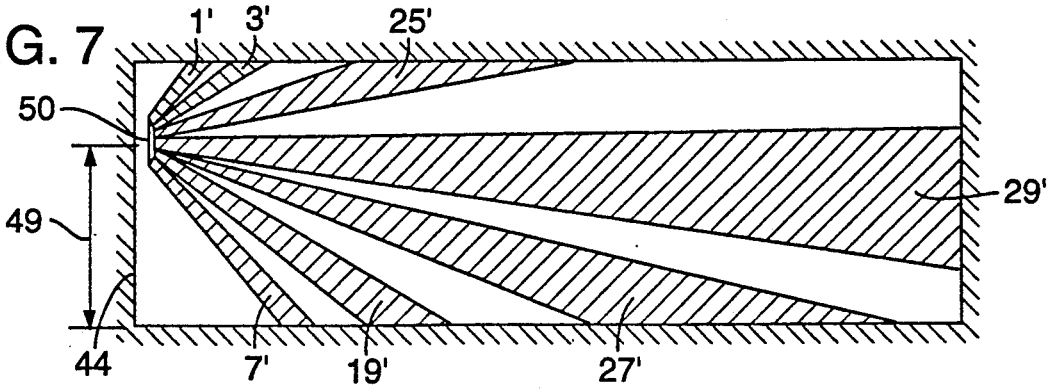
FIG. 7 is a schematic side view showing a plurality of beams of sensitivity defined by the lens grouping of the sensing device of FIG. 1 and falling in a vertical plane bisecting the lens unit when the sensing device is mounted on a wall.

The infrared sensing device 50 of the present invention can also be mounted on a wall. FIG. 6 is a schematic top view of the beams of sensitivity 10', 22', 28', 29', 26', 16', and 4' defined by the lens elements 10, 22, 28, 29, 26, 16, and 4 of FIG. 1 when the sensing device 50 is mounted on the wall 44. FIG. 7 is a schematic sectional side view of the beams of sensitivity 1', 13', 25', 29', 27', 19', and 7' defined by lens elements 1, 13, 25, 29, 27, 19, and 7 of FIG. 1 when the device is mounted on the wall 44 at a height 49 of about 7 feet.

The lens unit 30 has a vertical plane of symmetry 45, but is slightly asymmetrical with respect to a horizontal plane 46 defining a top portion 47 and a bottom portion 48 of the lens unit 30. The optical centers of the lens elements 10, 22, 28, 29, 26, 16, and 4 lie along a line parallel with the horizontal plane 46, but in the bottom portion 48 of the lens unit 30. Thus, the beams of sensitivity 10', 22', 28', 29', 26', 16', and 4' are depressed below horizontal when the sensing device 50 is mounted upright on the wall 44 as is best shown in FIG. 7. Preferably, the upper limiting rays or effective upper boundaries of those beams of sensitivity are horizontal, as illustrated in FIG. 7 particularly with respect to the beam of sensitivity 29'.

As previously mentioned, some of the Fresnel lens elements are larger than others. Larger lens elements 10, 22, 28, 29, 26, 16, and 4 are thus able to gather and focus a threshold amount of radiation on the detector 38 from a person at a greater distance from the sensing device 50 than is possible for the smaller lens elements 23, 24, 13, 14, and 15, for example, because of spreading of the radiation from a more distant person before it reaches the lens unit 30.

The incident-radiation-gathering ability of any one of the lens elements is a function of the effective area of the lens element. For lens grouping 40, the relative incident-radiation-gathering ability of the lens elements is shown below in Table 1. It will be understood that the described arrangement provides a lens grouping having a centrally located lens element with the greatest light gathering ability in the lens grouping.

TABLE 1

| Lens Element | Relative Incident-Radiation-Gathering Ability |
|---|---|
| 29 | 1.0 |
| 10, 22, 28, 26, 16, 4 | .50 to 1.0 |
| 1, 2, 3, 5, 6, 7, 8, 9, 11, 12, 13, 14, 15, 17, 18, 19, 20, 21, 23, 24, 25, 27 | .40 to .45 |

Figure 8:
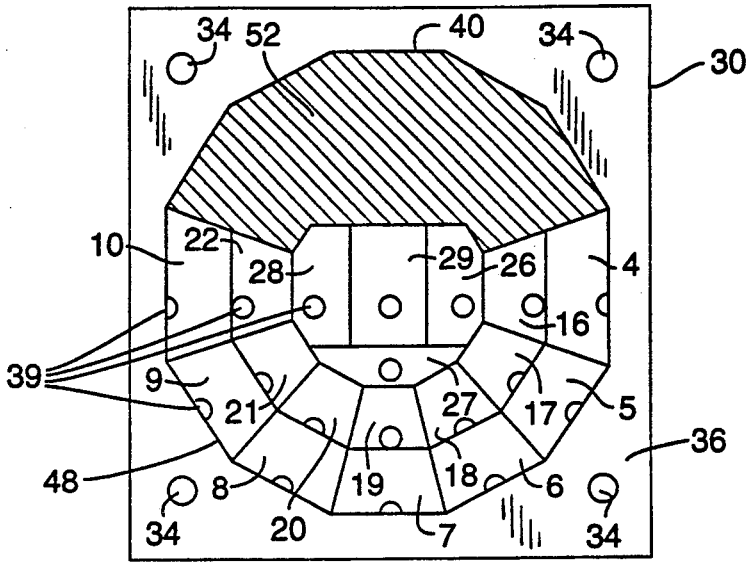
FIG. 8 is a front view of the lens unit of a sensing device as shown in FIG. 1 with some lens elements of the lens grouping shown symbolically as being masked, in preparation for a wall mounting.
Figure 9:
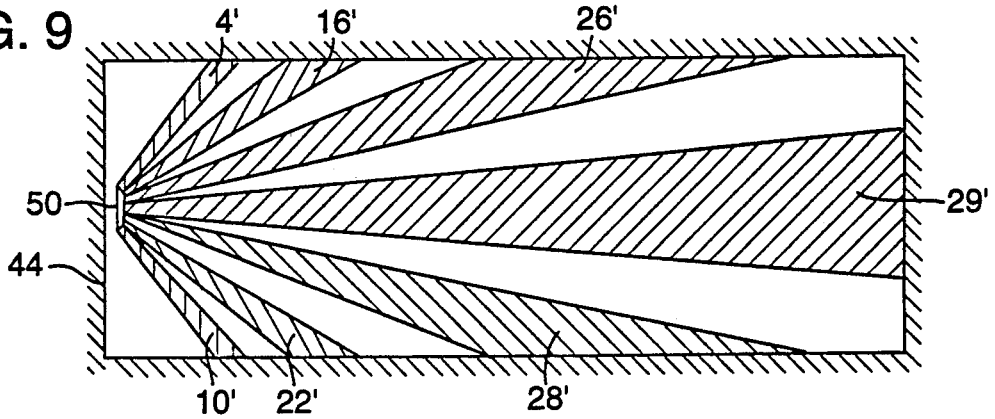
FIG. 9 is a schematic top view showing a plurality of beams of sensitivity as defined by a lens grouping according to the invention prepared as shown in FIG. 8 with the sensing device mounted on a wall.
Figure 10:
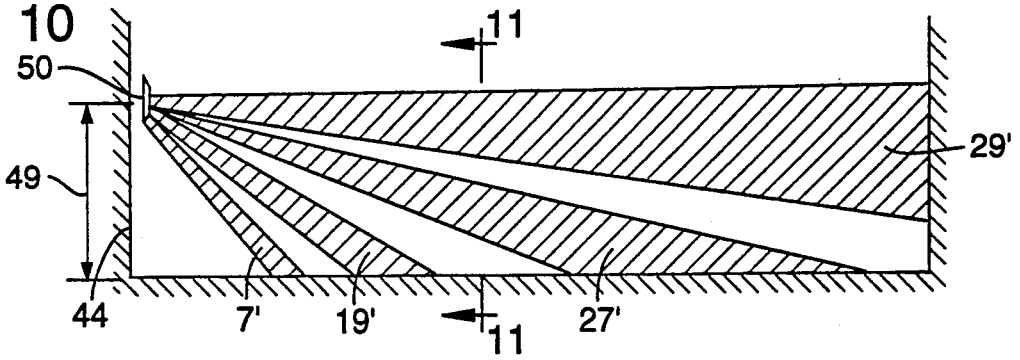
FIG. 10 is a schematic side view showing a plurality of beams of sensitivity as defined by a lens grouping according to the invention prepared as shown in FIG. 8 and falling in a vertical plane including the central axis of the lens unit with the sensing device mounted on wall.
Figure 11:
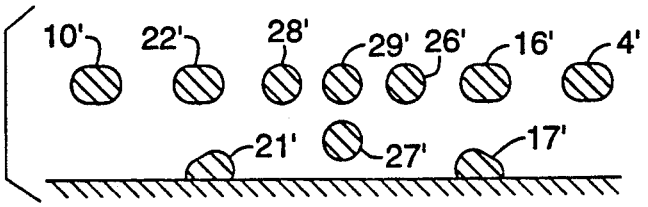
FIG. 11 is a schematic view showing a plurality of beams of sensitivity defined by a lens grouping according to the invention prepared as shown in FIG. 8, as projected on a plane parallel with the base of lens unit and including line 11—11 of FIG. 10.

Certain of the lens elements of the lens grouping can be masked, if desired, to create particular patterns of selected beams of sensitivity defined by the unmasked lens elements. For example, an infrared-opaque mask element 52 is cut to shape and adhesively attached to one or more lens elements of the lens grouping 40, as illustrated in FIG. 8. Fresnel lens elements 1, 2, 3, 11, 12, 13, 14, 15, 23, 24, and 25 have been masked with material that is opaque to radiation of the wavelengths to which the detector 38 is sensitive. Each unmasked lens element 4, 5, 6, 7, 8, 9, 10, 16, 17, 18, 19, 20, 21, 22, 26, 27, 28, and 29 defines its respective beam of sensitivity. If the resulting sensing device of FIG. 8 is mounted on a wall at a height 49 of about 7 feet a wide-angle pattern of beams of sensitivity results. The unmasked lens elements define beams of sensitivity extending generally out and down. FIG. 9 is a diagrammatic top view of the beams of sensitivity defined by the unmasked lens elements of FIG. 8. The beams of sensitivity 10', 22', 28', 29', 26', 16', and 4' defined by lens elements 10, 22, 28, 29, 26, 16 and 4 create a wide-angle pattern of beams of sensitivity for detection of infrared emissions. Beams of sensitivity 10', 22', 28', 29', 26', 16', 4', 21', 27', and 17' defined by lens elements 10, 22, 28, 29, 26, 16, 4, 21, 27, and 17 are projected onto a plane parallel with the base 36 of the lens unit while the beams of sensitivity defined by lens elements 5, 6, 7, 8, 9, 18, 19, and 20 of the lens grouping 40 extend onto the floor at distances dependent on the height above the floor at which the sensing device 50 is mounted on the wall 44, as shown in FIGS. 10 and 11. The sensing device can be mounted on wall or ceiling at a height of up to 12 feet.

Figure 12:
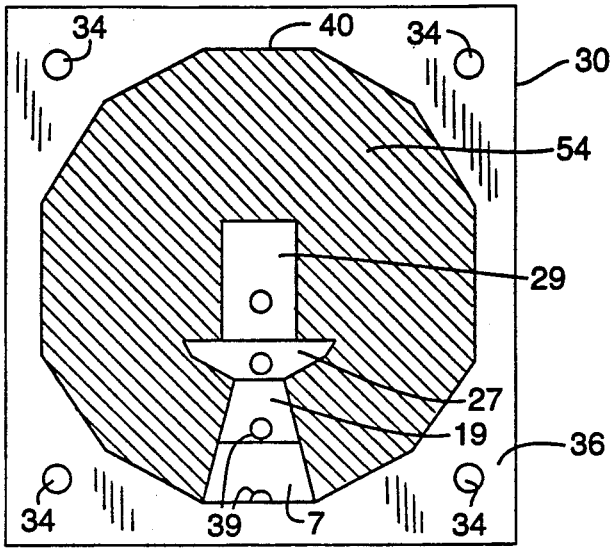
FIG. 12 is a front view of the lens unit of a sensing device as shown in FIG. 1 with portions of the lens grouping shown symbolically as being masked in preparation for a wall mounting.
Figure 13:
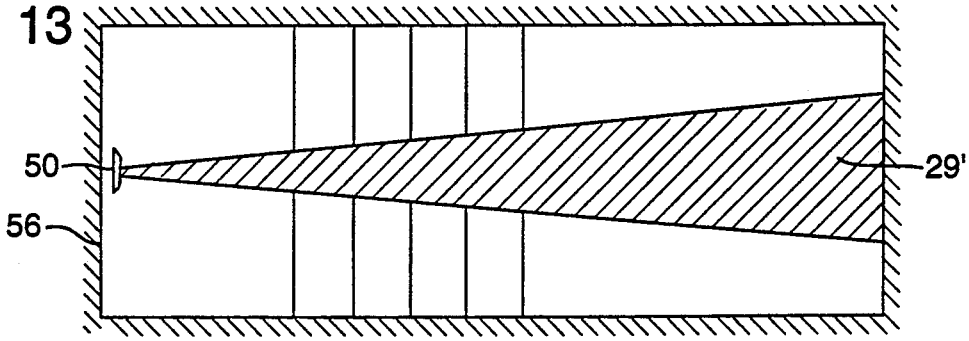
FIG. 13 is a schematic top view showing a plurality of beams of sensitivity as defined by a lens grouping according to the invention prepared as shown in FIG. 12 with the sensing device mounted on a wall.
Figure 14:
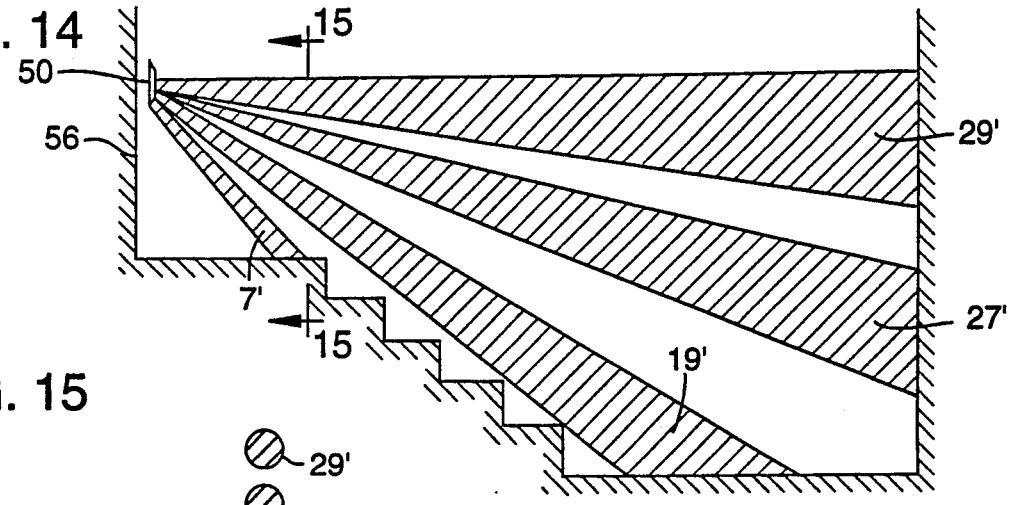
FIG. 14 is a schematic side view showing a plurality of beams of sensitivity as defined by the lens grouping of FIG. 12 with the sensing device mounted on a wall.
Figure 15:
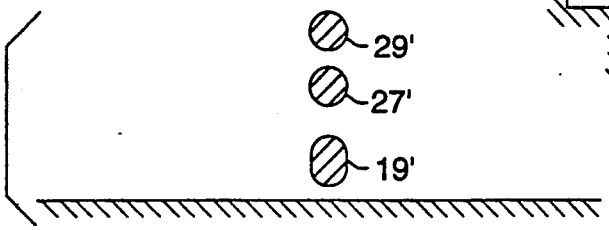
FIG. 15 is a schematic view showing a plurality of beams of sensitivity taken in a plane including line 15—15 of FIG. 14 and parallel to the wall on which the sensing device is shown mounted in FIG. 14.

An infrared-opaque mask element 54 may be cut to shape and fastened by adhesive or other means over the lens grouping 40 as illustrated in FIG. 12. Lens elements 29, 27, 19, and 7 remain unmasked, defining beams of sensitivity 29', 27', 19', and 7' in an array that is generally vertical and planar. An infrared sensor with the lens grouping masked as depicted in FIG. 12 would be particularly useful for providing long range intrusion detection in areas such as halls and stairways. FIG. 13 is a schematic top view of the beams of sensitivity projected by the unmasked lens elements of the infrared detection device depicted in FIG. 12 when the device is mounted on the wall 56 at the top of a stairwell. FIG. 14 is a side view of the vertical curtain of detection formed by the beams of sensitivity 7', 19', 27', and 29' defined by the unmasked lens elements 7, 19, 27, and 29 as shown in FIG. 12. FIG. 15 shows the coverage of the beams of sensitivity 29', 27', and 19' in a plane at the line 15—15 and parallel to the wall 56 on which the sensing device 50 is shown mounted in FIG. 14. FIG. 14 also illustrates the usefulness of one way to mask the lens unit 30.

Figure 16:
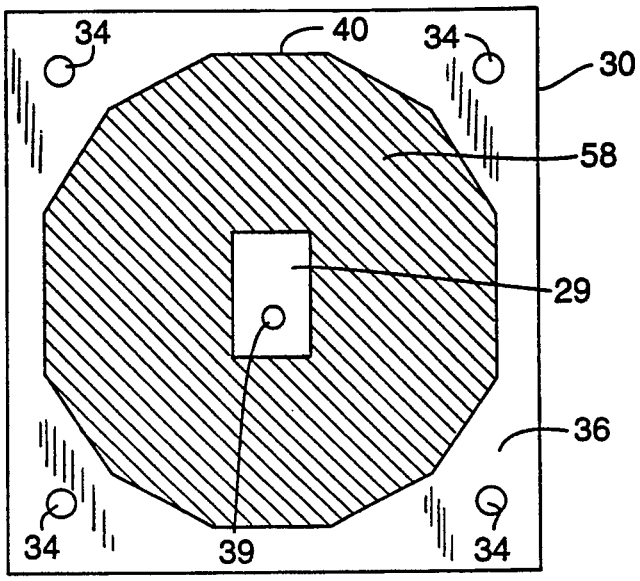
FIG. 16 is a front view of the lens unit of a sensing device as shown in FIG. 1 with portions of the lens grouping shown symbolically as being masked in preparation for a wall mounting.
Figure 17:
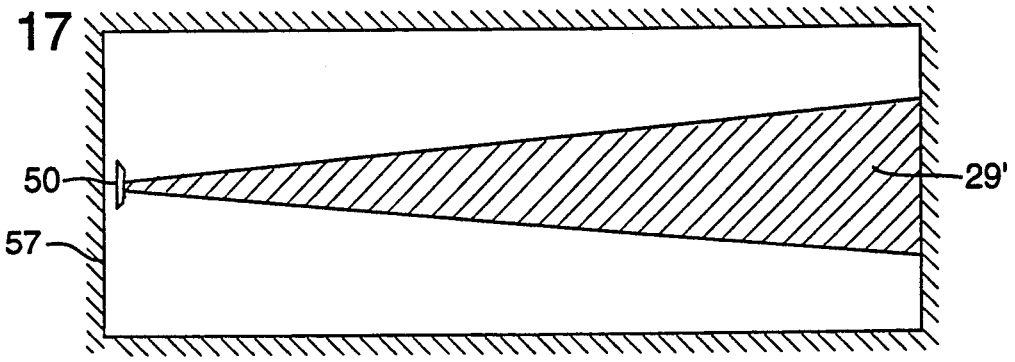
FIG. 17 is a schematic top view showing the beam of sensitivity defined by the lens grouping of FIG. 16 with the sensing device mounted on a wall.
Figure 18:
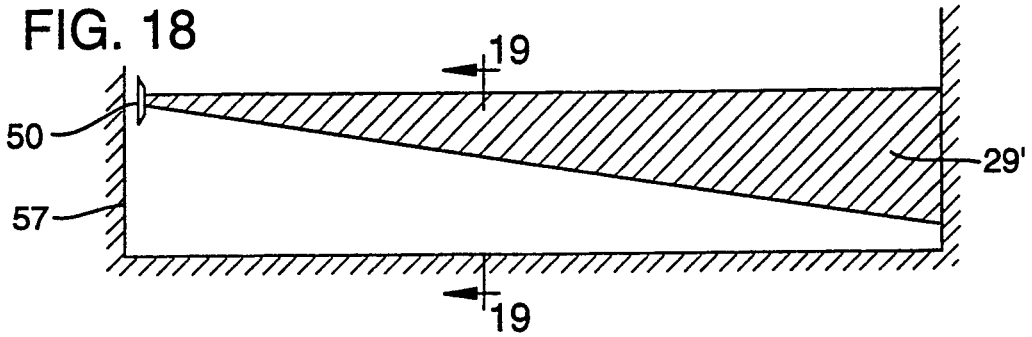
FIG. 18 is a schematic side view showing the beam of sensitivity as defined by the lens grouping of FIG. 16 with the sensing device mounted on a wall.
Figure 19:
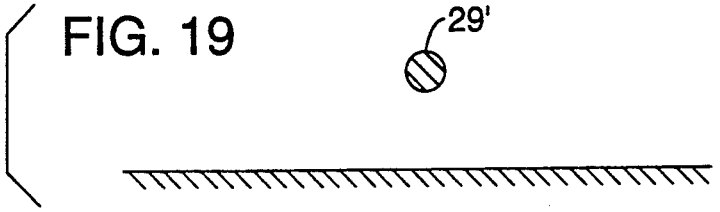
FIG. 19 is a schematic view showing the beam of sensitivity defined by the lens grouping shown in FIG. 16, taken in a plane including line 19—19 and parallel to the wall on which the sensing device is shown mounted in FIG. 18.

FIG. 16 is a schematic front view of the lens unit 30 with an infrared-opaque mask 58 affixed, leaving unmasked only the central Fresnel lens element 29 of the lens grouping 40. This unmasked Fresnel lens element 29 defines a long range beam of sensitivity 29' making the infrared sensing device 50 especially useful when wall-mounted at an end of a hall, since heat from windows and doorways along such a hall would not present a false detection problem. FIG. 17 is a schematic top view and FIG. 18 is a schematic side view of the beam of sensitivity 29' defined by lens element 29 of FIG. 16. FIG. 19 shows the coverage of beam of sensitivity 29' taken at a plane including line 19—19 of FIG. 18 parallel to the wall 57 on which the sensing device 50 is shown mounted in FIGS. 13 and 14. This configuration can also be used to provide intrusion detection by positioning the detection device to direct the beam of sensitivity defined by the single unmasked lens element 29 across a bank of windows or toward an attic trap door.

Figure 20:
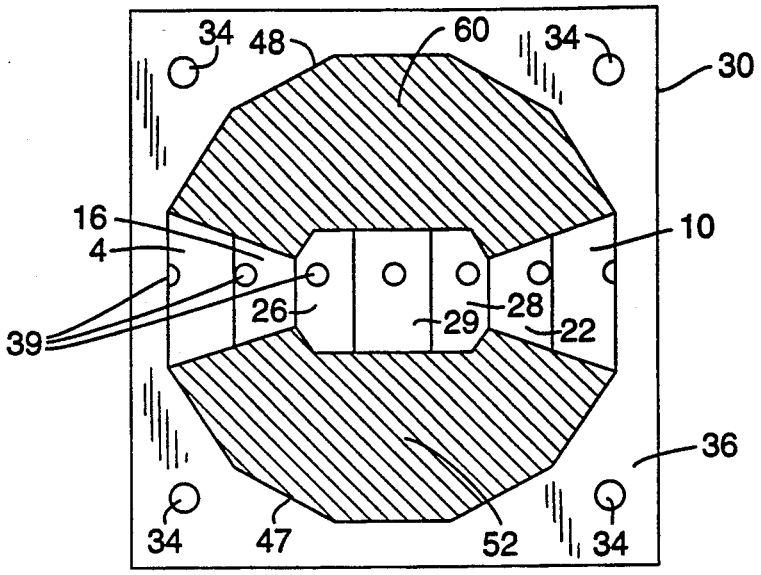
FIG. 20 is a front view of the lens unit of a sensing device rotated 180° from its orientation as shown in FIG. 1, with portions of the lens grouping shown symbolically as being masked in preparation for a wall mounting.
Figure 21:
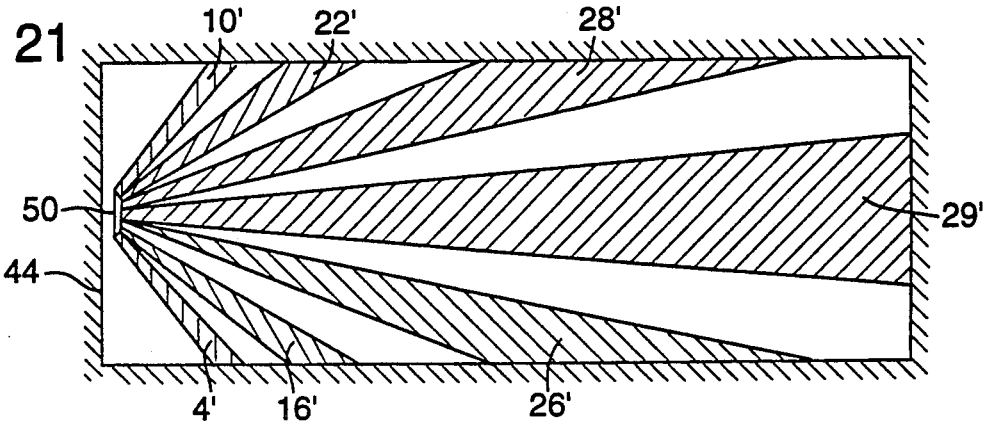
FIG. 21 is a schematic top view showing a plurality of beams of sensitivity as defined by the lens grouping of FIG. 20 with the sensing device mounted on a wall.
Figure 22:
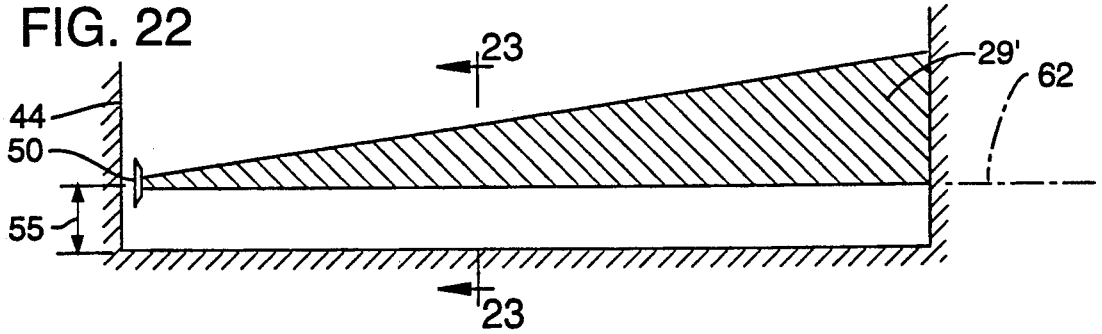
FIG. 22 is a schematic side view showing a plurality of beams of sensitivity as defined by the lens grouping of FIG. 20 with the sensing device mounted on a wall.
Figure 23:
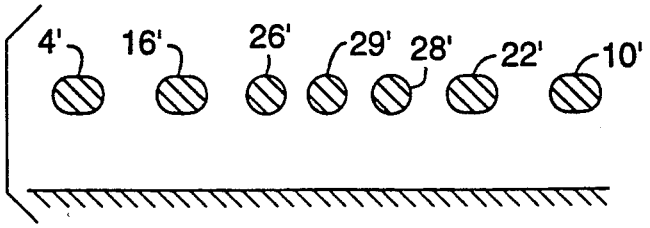
FIG. 23 is a schematic view showing a plurality of beams of sensitivity defined by the lens grouping of FIG. 20, taken in a plane including line 23—23 and parallel to the wall on which the sensing device is shown mounted in FIG. 22.

An essentially horizontal fan of beams of sensitivity can be provided by masking all but the lens elements that define a planar array of beams of sensitivity. Such a planar array is defined by the unmasked lens elements 4, 16, 26, 29, 28, 22, and 10, as illustrated in FIG. 20. Infrared-opaque masks 52, 60 adhere to a lens unit 30 such as is shown in FIG. 1. In FIG. 20 lens elements 4, 16, 26, 29, 28, 22, and 10 define beams of sensitivity 4', 16', 26', 29', 28', 22' and 10' which form a wide-angle, fan shape of infrared radiation sensitivity. The intrusion detection device 50 with the lens unit 30 masked as illustrated in FIG. 20 can be mounted on a wall, 3 to 4 feet above the floor, in an inverted orientation with the bottom 48 of the lens unit 30 closer to the ceiling. In this configuration the lens elements define the beams of sensitivity 4', 16', 26', 29', 28', 22', and 10' in an upward and outward direction with the lower boundaries of the beams of sensitivity defining generally a horizontal plane 62 as depicted in FIGS. 21 and 22. FIG. 22 is a schematic side view of the beams of sensitivity defined by the sensing device 50 mounted at a height 55 of three and one-half feet above the floor. FIG. 23 shows schematically the coverage of the available beams of sensitivity 4', 16', 26', 29', 28', 22', and 10' in a plane including the line 23—23 of FIG. 22 and parallel to the wall 44 on which the sensing device 50 is shown mounted in FIG. 22. As best shown in FIG. 22 this configuration and method of mounting leave a space immediately above the floor in which infrared radiation detection does not occur. The sensing device 50 can be mounted on the wall 44, then, at an appropriate height to allow animals to move about in the space below the beams of sensitivity without being detected. Thus, a space can be provided in a room in which pets can move about freely while infrared detection protection is still provided above the height defined by the lower boundaries of the beams of sensitivity defined by the unmasked lens elements.

Figure 24:
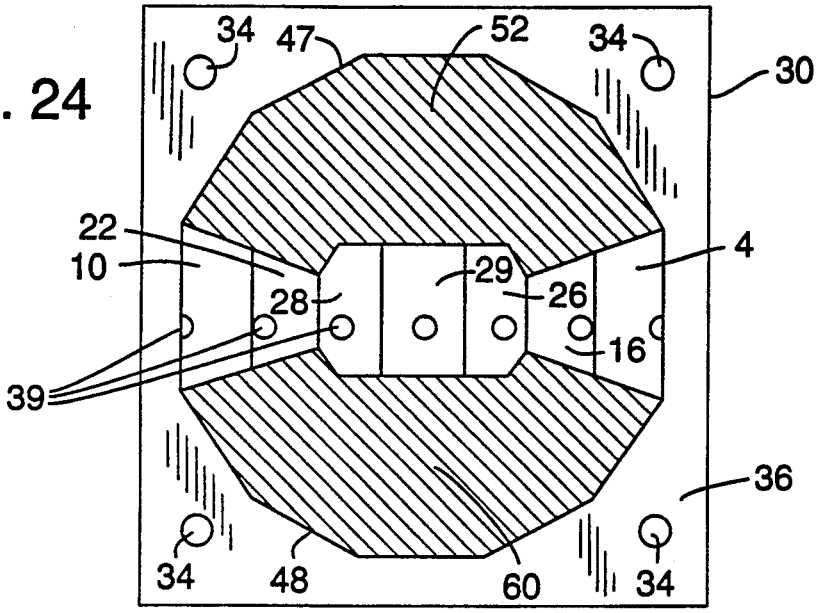
FIG. 24 is a front view of the lens unit of a sensing device as shown in FIG. 1 with portions of the lens grouping shown symbolically as being masked in preparation for mounting the sensing device on a ceiling.
Figure 25:
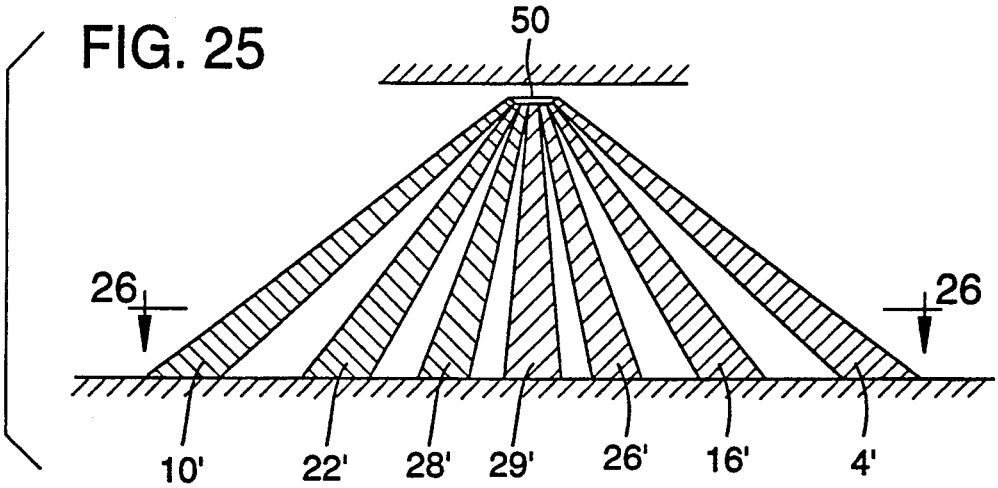
FIG. 25 is a schematic side view showing a plurality of beams of sensitivity in a curtain-like array defined by the lens grouping of FIG. 24 when the sensing device is mounted on a ceiling.
Figure 26:
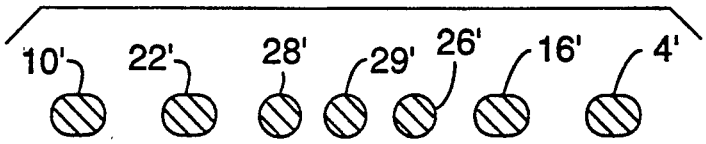
FIG. 26 is a schematic view showing the plurality of beams of sensitivity defined by the lens grouping as shown in FIG. 24 mounted on a ceiling, and taken in a horizontal plane including line 26—26.

A vertical curtain pattern of infrared detection can also be provided by mounting the intrusion detection device depicted in FIG. 24 on a ceiling. The beams of sensitivity 10', 22', 28', 29', 26', 16', and 4' defined by the lens elements 10, 22, 28, 29, 26, 16, and 4 are schematically indicated in FIG. 25. FIG. 26 shows schematically the coverage of the available beams of sensitivity 10', 22', 28', 29', 26', 16', and 4' in a plane including the line 26—26 of FIG. 25 and parallel to the ceiling on which the sensing device 50 is shown mounted in FIG. 22.

As has been pointed out, an adhesive-backed infrared-opaque mask can be used selectively to obscure any Fresnel lens element by blocking the passage of infrared radiation therethrough. It will be appreciated, therefore, that many other infrared radiation detection patterns can be achieved by selective masking of certain lens elements of the lens grouping. For example, as illustrated in FIG. 27, all lens elements, except the lens elements 1, 13, 25, 29, 27, 19, and 7 lying in a vertical plane and all the lens elements 10, 22, 28, 29, 26, 16, and 4 lying a horizontal plane, could be masked with mask elements 64. The generally planar array of the beams of sensitivity 1', 13', 25', 29', 27', 19', and 7' defined by unmasked Fresnel lens elements 1, 13, 25, 29, 27, 19, and 7 would thus intersect at right angles with the generally planar array of the beams of sensitivity 10', 22', 28', 29', 26', 16', and 4' defined by unmasked Fresnel lens elements 10, 22, 28, 29, 26, 16, and 4 as illustrated in FIG. 28. It will be appreciated that by additionally masking lens elements 1, 13, and 25, the beams of sensitivity defined by those lens elements 1', 13', and 25' would be eliminated from the illustration of FIG. 28 resulting in another useful pattern of detection. Alternatively, though not illustrated, lens elements could be masked so that planar arrays of the beams of sensitivity defined by the unmasked lens elements intersect at some angle that is not a right angle. For instance, masking all lens elements except lens elements 12, 24, 18 and 6 and lens elements 2, 14, 20, and 8 results in a generally planar array of beams of sensitivity 12', 24', 18', and 6' and a generally planar array of beams of sensitivity 2', 14', 20', 8'; these two generally planar arrays of beams of sensitivity intersect at an acute angle.

Any combination of lens elements can be masked so that the unmasked elements define beams of sensitivity to give the best pattern of infrared detection for the desired application. For example, FIG. 29 illustrates a pattern of beams of sensitivity which may be desirable in providing intrusion detection in an oddly-shaped room or in a room in which it is desired to avoid the effects of a bay window. As is well known, it may also be desirable to mask certain lens elements which would otherwise detect infrared radiation from sources such as the sun or heating ducts and hot air registers or radiators. It will also be appreciated that, if desired, the selected pattern of unmasked lens elements can be changed by removing an infrared opaque mask of one shape and substituting an infrared opaque mask of a different shape, or, alternatively, by merely adding additional masks to the originally selected pattern of unmasked lens elements.

Figure 30:
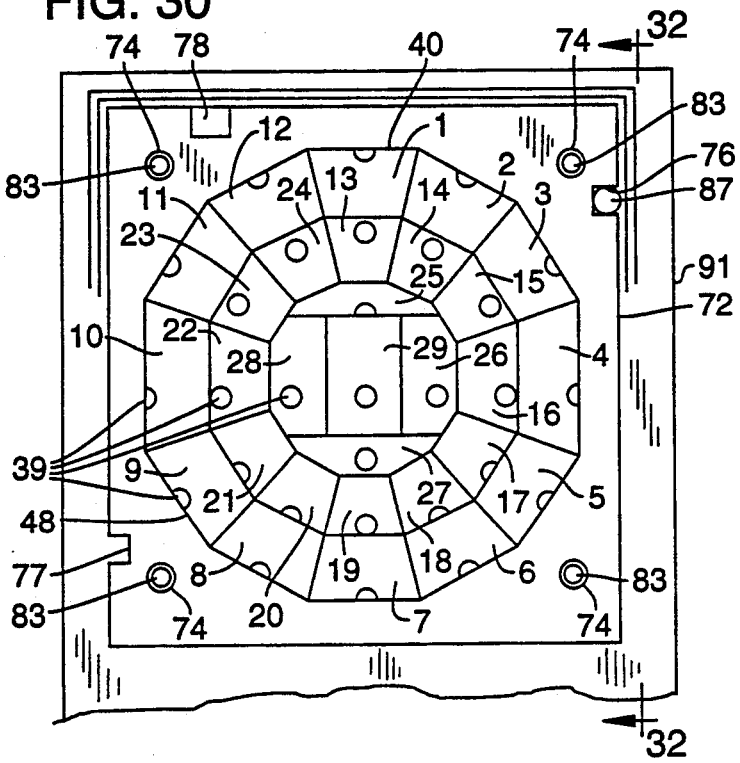
FIG. 30 is a front view of a lens unit and part of a housing constructed to accept a unitary mask element according to one embodiment of the invention.
Figure 32:
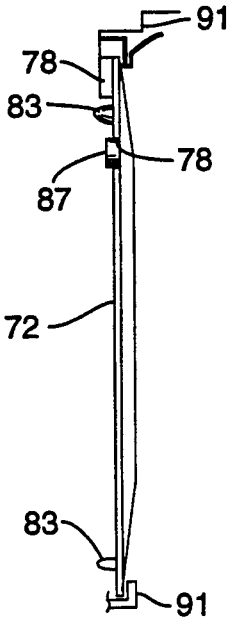
FIG. 32 is a side view of the lens unit and part of a housing shown in FIG. 30 taken in the direction of line 32—32.
Figure 31:
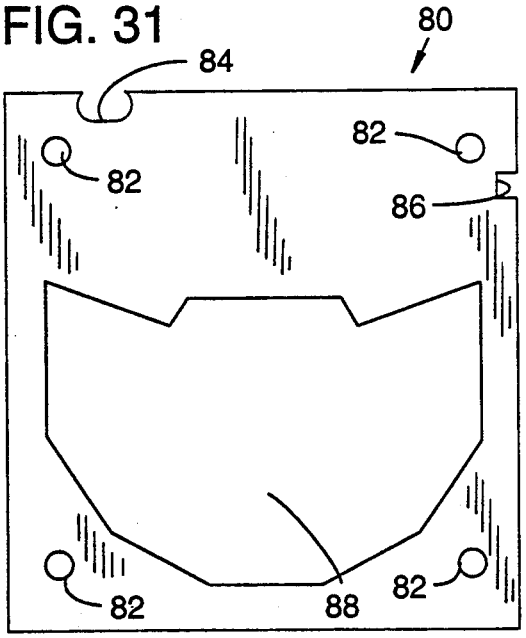
FIG. 31 is a front view of a unitary mask element for use with a lens unit such as that shown in FIG. 30 for providing wide-angle intrusion detection.

In an alternative embodiment of the invention, a unitary mask element, such as mask element 80 shown in FIG. 31, can be placed over a lens unit 72, shown in FIG. 30, which is similar to the lens unit 30, except for certain details to be described presently. The unitary mask element 80 can be fashioned of an infrared-opaque sheet-like material that is rigid enough to retain its shape and support its own weight when placed between a lens unit and an infrared detector. The material must also be thin enough to fit between the lens unit and the detector element without displacing the lens unit enough to disturb significantly its ability to focus infrared radiation on the infrared detector. Infrared-opaque paper or plastic of a suitable weight, or a sheet material coated, if necessary, with an infrared-opaque coating, may be used for the mask element 80.

Figure 33:
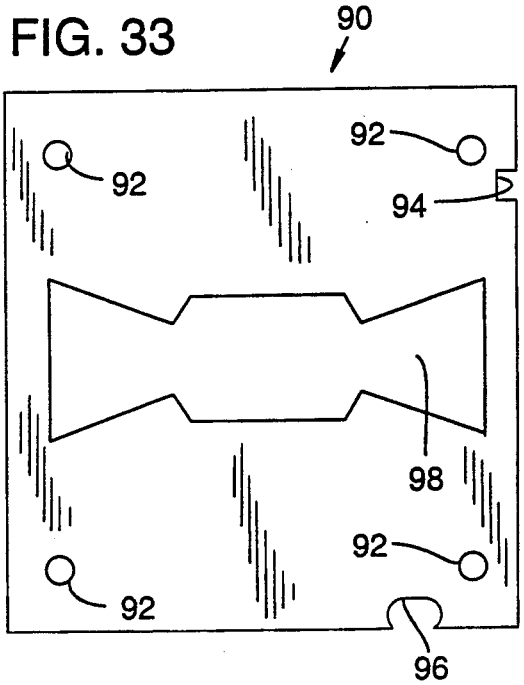
FIG. 33 is a front view of a unitary mask element for use with a lens unit such as that shown in FIG. 30 for providing intrusion detection over a pet alley.

The mask element 80 covers the lens unit 72 and is shaped to obscure the entire lens unit 72 except those lens elements defining particular zones of detection for particularly useful infrared detection protection. Thus, for example, a unitary mask element 80 is shaped to define wide angle coverage when mounted on a lens unit 72, by leaving lens elements 4, 5, 6, 7, 8, 9, 10, 16,

17, 18, 19, 20, 21, 22, 26, 27, 28, and 29 unobstructed. A similar unitary mask element 90, illustrated in FIG. 33, is shaped to define intrusion detection over a pet alley when properly mounted on a lens unit 72, by leaving lens elements 4, 16, 26, 29, 28, 22, and 10 unobstructed, with the lens unit 72 installed so that the lens element 13 is lowermost.

As seen in FIGS. 30 and 31, lens unit 72 has holes 74, whose locations correspond with the locations of holes 82 of the mask element 80, to keep the mask element 80 aligned with the lens element 72. Holes 74 and 82 fit over pegs 83 on the lens housing 91. Notch 86 on the mask element 80 and slot 76 in the lens unit both fit around a properly sized projection 87 on the lens housing 91 to keep both the lens unit 72 and the mask element 80 properly oriented with respect to the body of the sensing device 50. When the mask element 80 is properly mounted between the lens unit 72 and the infrared detecting element, notch 84 on the mask element 80 is aligned over protuberance 78 on the lens unit. This system of holes, pegs, notches and projections insures proper orientation and secure attachment of the mask element 80 over the lens unit 72.

It will be noted that when mask element 80 is in place between the infrared detector and lens unit 72 the unmasked lens elements left exposed by opening 88 will define beams of sensitivity similar to the beams of sensitivity defined by the unmasked lens elements illustrated in FIG. 8.

In similar fashion other unitary mask elements (not all shown) can be fashioned so that when a particular mask element is in place over a lens unit, the unmasked lens elements define beams of sensitivity or projected detection zones suitable, for example, to define a pet alley, a vertical barrier or a long range single spot for infrared intrusion detection. A unitary mask element 90, as shown in FIG. 33, when placed between lens unit 72 and the infrared detecting element, would define the zones of sensitivity over a pet alley when included in a sensing device 50 properly mounted on a wall. As previously described for lens unit 30 and infrared opaque masks 52, 80, the lens unit 72 in defining such a pet alley is masked to provide an essentially planar horizontal fan-like array of beams of sensitivity.

It will also be noted that, to provide this essentially horizontal fan of beams of sensitivity, lens unit 72 will be mounted in an inverted orientation, permitted by the symmetry of the locations of the pegs 83 and the holes 74 and 92. As illustrated in FIGS. 30 and 33, when lens unit 72 is inverted, holes 92 of the unitary mask element 90 align with the holes 74 of the lens unit 72, notch 94 of the unitary mask element corresponds with slot 77 of the lens unit 72, and notch 96 of the unitary mask element 90 will fit over protuberance 78 of the lens unit 72. When masked in this manner the lens unit 72 provides a pattern of beams of sensitivity similar to the patterns seen in FIGS. 21, 22, and 23 as defined by the masked lens unit 30 illustrated in FIG. 20.

The terms and expressions which have been employed in the foregoing specification are used therein as terms of description and not of limitation, and there is no intention in the use of such terms and expressions of excluding equivalents of the features shown and described or portions thereof, it being recognized that the scope of the invention is defined and limited only by the claims which follow.

What is claimed is:

1. A lens arrangement for use in a sensing device capable of being mounted either on a wall or a ceiling for detecting the presence of persons or animals, comprising:

(a) a lens grouping adapted to refract incident radiation having a predetermined characteristic wavelength, said lens grouping having a central axis and defining respective mutually perpendicular first and second planes each including said central axis, and said lens grouping including at least five lens elements, each of said lens elements having an optical axis, radiation having said predetermined wavelength and traveling along each said optical axis being focused generally on a focal point, said at least five lens elements including:

(i) a primary lens element having an optical axis oriented in a preferred direction relative to said lens grouping and having an incident-radiation-gathering ability, said first plane including said optical axis of said primary lens element;

(ii) a plurality of secondary lens elements in addition to said primary lens element, each secondary lens element having a respective optical axis oriented in a respective secondary direction relative to said lens grouping and having a respective incident-radiation-gathering ability no greater than that of said primary lens element, said optical axes of said primary lens element and at least two of said secondary lens elements defining a third plane mutually perpendicular with said first plane but not parallel with said second plane; and (iii) a plurality of tertiary lens elements in addition to said primary lens element and said secondary lens elements, each tertiary lens element having a respective optical axis oriented in a respective tertiary direction relative to said lens grouping and having a respective incident-radiation-gathering ability less than that of any of said primary lens element and said secondary lens elements, some of said plurality of tertiary lens elements being arranged in an arcuately curved row located in said lens grouping on one side of said second plane, said optical axes of said plurality of tertiary lens elements in said row defining partially the surface of a cone containing therein said optical axis of said primary lens element.

2. The lens arrangement of claim 1 wherein a majority of said plurality of tertiary lens elements are arranged in two concentric pairs of arcuately curved rows, one of said pairs of rows being located in said lens grouping on each side of said second plane, and wherein said optical axes of the particular tertiary lens elements arranged in each said row define partially the surface of a respective cone containing therein said optical axis of said primary lens element.

3. The lens arrangement of claim 1 wherein the incident-radiation-gathering ability of each said secondary lens element is no more than 70% as great as that of said primary lens element.

4. The lens arrangement of claim 3 wherein the incident-radiation-gathering ability of each said tertiary lens element is no more than 45% as great as that of said primary lens element.

5. The lens arrangement of claim 1 wherein said primary lens element and said secondary lens elements define respective beams of sensitivity having effective boundaries extending along said second plane.

6. A sensing device for use in detecting the presence of persons or animals and capable of being mounted on either a wall or a ceiling, comprising:

(a) sensitive means for detecting radiation having a predetermined characteristic wavelength; and (b) a lens grouping adapted to refract incident radiation having said predetermined characteristic wavelength, said lens grouping being mounted in a predetermined location with respect to said sensitive means and said lens grouping having a central axis and defining respective mutually perpendicular first and second planes each including said central axis, and said lens grouping having at least five lens elements, each of said lens elements having an optical axis, radiation having said predetermined wavelength and traveling along each said optical axis being focused generally on a focal point located proximate said sensitive means, said at least five lens elements including:

(i) a primary lens element having an optical axis oriented in a preferred direction relative to said lens grouping and having an incident-radiation-gathering ability, said first plane including said optical axis of said primary lens element;

(ii) a plurality of secondary lens elements in addition to said primary lens element, each secondary lens element having a respective optical axis oriented in a respective secondary direction relative to said lens grouping and having a respective incident-radiation-gathering ability no greater than that of said primary lens element, said optical axes of said primary lens element and at least two of said secondary lens elements defining a third plane mutually perpendicular with said first plane but not parallel with said second plane; and (iii) a plurality of tertiary lens elements in addition to said primary lens element and said secondary lens elements, each tertiary lens element having a respective optical axis oriented in a respective tertiary direction relative to said lens grouping and having a respective incident-radiation-gathering ability less than that of any of said primary lens element and said secondary lens elements, some of said plurality of tertiary lens elements being arranged in an arcuately curved row located in said lens grouping on one side of said second plane, said optical axes of said plurality of tertiary lens elements in said row defining partially the surface of a cone containing therein said optical axis of said primary lens element.

7. The sensing device of claim 6 wherein said tertiary lens elements are arranged in two concentric pairs of arcuately curved rows, one of said pairs of rows being located in said lens grouping on each side of said second plane, and wherein said optical axes of the particular tertiary lens elements arranged in each said row define partially the surface of a respective cone containing therein said optical axis of said primary lens element.

8. The sensing device of claim 6 wherein the incident-radiation-gathering ability of each said secondary lens element is no more than 70% as great as that of said primary lens element.

9. The sensing device of claim 8 wherein the incident-radiation-gathering ability of each said secondary lens element is no more than 45% as great as that of said primary lens element.

10. The sensing device of claim 6 wherein said primary lens element and said secondary lens elements define respective beams of sensitivity having effective boundaries extending along said second plane.

11. A sensing device with a masking system for detecting the presence of persons or animals and capable of being mounted on either a wall or a ceiling, comprising:

(a) sensitive means for detecting radiation having a predetermined characteristic wavelength;

(b) a lens grouping adapted to refract incident radiation having said predetermined characteristic wavelength, said lens grouping having a central axis and defining respective mutually perpendicular first and second planes each including said central axis, and said lens grouping having at least five lens elements, each of said lens elements having an optical axis, radiation having said predetermined wavelength and traveling along each said optical axis being focused generally on a focal point located proximate said sensitive means, said at least five lens elements including:

(i) a primary lens element having an optical axis oriented in a preferred direction relative to said lens grouping and having an incident-radiation-gathering ability, said first plane including said optical axis of said primary lens element;

(ii) a plurality of secondary lens elements in addition to said primary lens element, each secondary lens element having a respective optical axis oriented in a respective secondary direction relative to said lens grouping and having a respective incident-radiation-gathering ability no greater than that of said primary lens element, said optical axes of said primary lens element and any two of said secondary lens elements defining a third plane mutually perpendicular with said first plane but not parallel with said second plane; and (iii) a plurality of tertiary lens elements in addition to said primary lens element and said secondary lens elements, each tertiary lens element having a respective optical axis oriented in a respective tertiary direction relative to said lens grouping and having a respective incident-radiation-gathering ability less than that of any of said primary lens element and said secondary lens elements;

(c) housing means for carrying said lens grouping thereon in a predetermined location with respect to said sensitive means;

(d) unitary mask means, opaque to radiation of said predetermined characteristic wavelength, located adjacent said lens grouping, for preventing radiation from reaching said sensitive means through selected ones of said lens elements, said mask means defining an opening therein to permit passage of radiation of said predetermined characteristic wavelength toward said sensitive means, said mask means being stiff yet resiliently flexible and having marginal portions, and;

(e) attachment means, associated with said marginal portions of said unitary mask means, for releasably fastening said mask means to said housing means adjacent said lens grouping.

12. The sensing device of claim 11 wherein said unitary mask means is self-supporting.

13. The sensing device of claim 11 wherein said unitary mask means defines therein a respective opening of a predetermined size and shape to permit passage of said radiation to said sensitive means through at least one selected lens element of said lens grouping.

14. The sensing device of claim 13 wherein said unitary mask means defines an opening therein predetermined to permit passage of said radiation to said sensitive means through only said primary lens element of said lens grouping.

15. The sensing device of claim 13 wherein said unitary mask means defines an opening therein predetermined to permit passage of said radiation to said sensitive means through only said primary lens element and said secondary lens elements of said lens grouping.

16. The sensing device of claim 13 wherein said unitary mask means defines an opening therein predetermined to permit passage of said radiation to said sensitive means through only said primary lens element and said tertiary lens elements of said lens grouping.

17. The sensing device of claim 13 wherein said unitary mask means defines an opening therein predetermined to permit passage of said radiation to said sensitive means through only said primary lens element and at least some, but less than all, of said secondary lens elements and at least some, but less than all, of said tertiary elements of said lens grouping.

18. The sensing device of claim 11 wherein said mounting means and said attachment means each include alignment means for orienting said lens grouping and said mask means in said housing means.

19. The sensing device of claim 11 wherein said primary lens element and said secondary lens elements define respective beams of sensitivity having effective boundaries extending along said second plane.

* * * * *